US005896715A

United States Patent [19]

Maupas

[11] Patent Number: 5,896,715

[45] Date of Patent: Apr. 27, 1999

[54] SYSTEM FOR ASSEMBLING PREFABRICATED PANELS TO MAKE A WALL, E.G. FOR A SWIMMING POOL, AND A SWIMMING POOL WALL OBTAINED THEREBY

[75] Inventor: Alain Maupas, Locmariaquer, France

[73] Assignee: S.A.R.L. A.M. Consultant, Locmaiaquer, France

[21] Appl. No.: 08/831,047

[22] Filed: Apr. 1, 1997

[30] Foreign Application Priority Data

Apr. 2, 1996 [FR] France ..... 96 04106

[51] Int. Cl.[6] ..... E04C 3/00

[52] U.S. Cl. ..... 52/465; 52/461; 4/506

[58] Field of Search ..... 52/169.7, 459, 52/461, 463, 464, 465, 467, 468; 4/506

[56] References Cited

U.S. PATENT DOCUMENTS

| | | | |
|---|---|---|---|
| 2,055,127 | 9/1936 | Goodwin | 52/463 |
| 2,446,323 | 8/1948 | Davis et al. | 52/459 X |
| 3,193,847 | 7/1965 | Mashura . | |
| 3,302,825 | 2/1967 | Schleeweiss . | |
| 3,832,820 | 9/1974 | Eggert | 52/461 X |
| 3,971,075 | 7/1976 | Heinbaugh et al. | 52/461 X |

FOREIGN PATENT DOCUMENTS

| | | | |
|---|---|---|---|
| 2233458 | 1/1975 | France . | |
| 883819 | 7/1953 | Germany | 52/464 |
| 288652 | of 1953 | Switzerland | 52/464 |

*Primary Examiner*—Creighton Smith

*Attorney, Agent, or Firm*—Bell Seltzer Intellectual Property Law Group of Alston & Bird LLP

[57] ABSTRACT

A system for assembling together prefabricated panels to form a water-retaining wall, in particular a swimming pool wall, each panel being constituted by a sheet metal plate having two opposite edges, defining substantially the height of the wall, which edges are folded to the same side of the panel to form two flanges, the system being characterized in that two consecutive panels disposed vertically side by side are assembled together by matching shapes between the two adjacent flanges (3) of the two panels (1) and two rectilinear section members (7, 9) comprising a first section member (7) having a C-shaped right cross-section which is designed to be fitted over the two adjacent flanges (3) of the two panels (1), and a second section member (9) which is designed to be engaged inside the first section (7) and between the adjacent flanges (3) of the two panels (1), together with stiffening means for locking the two flanges (3) into position between the two section members (7, 9).

12 Claims, 2 Drawing Sheets

SYSTEM FOR ASSEMBLING PREFABRICATED PANELS TO MAKE A WALL, E.G. FOR A SWIMMING POOL, AND A SWIMMING POOL WALL OBTAINED THEREBY

The present invention relates to a system for assembling together prefabricated panels to make a water-retaining wall, e.g. a swimming pool wall.

In general, the problems posed by the prefabricated panels used for mounting a swimming pool wall relate in particular to the cost of manufacturing them, storing them, transporting them, and mounting them.

To reduce manufacturing costs, it is known to implement each panel in the form of a sheet metal plate having two opposite edges extending in the height direction of the wall and that are folded through 90° in the same direction so as to form two flanges.

To assemble together two consecutive panels, the panels are placed vertically and juxtaposed in line with each other so that their two adjacent flanges come into contact with each other, and then assembly proper is performed by using bolts along the two flanges. Such an assembly requires a very large number of bolts to assemble together all of the panels of the wall, which number may be as many as 200 for a swimming pool measuring 8 meters (m)×4 m×1.07 m.

To keep down the number of bolts, some manufacturers have not hesitated to increase the length of each panel, but that is to the detriment of storing the panels on the premises of a distributor, to the detriment of transporting them to a site of use, and to the detriment of handling them on site in order to assemble them together. In other words, for this type of prefabricated swimming pool which is intended, in particular, to be assembled on domestic premises, individuals can no longer perform transport and assembly operations themselves.

In addition, the lack of stiffness of large panels means that it is necessary to add reinforcing angle bar members to the backs of the panels. Fixing such angle bar members by welding is expensive and damages the anticorrosion coating of the panels.

The object of the invention is to design a water-retaining wall, in particular a swimming pool wall, that is built up by assembling together prefabricated sheet metal panels, and that is capable of solving in satisfactory manner the problems posed by walls of this type, namely manufacturing costs, storage costs, transport costs, and costs of assembling the panels together.

To this end, the invention provides a system for assembling together prefabricated panels to form a water-retaining wall, in particular a swimming pool wall, each panel being constituted by a sheet metal plate having two opposite edges, defining substantially the height of the wall, which edges are folded to the same side of the panel to form two flanges, the system being characterized in that two consecutive panels disposed vertically side by side are assembled together by matching shapes between the two adjacent flanges of the two panels and two rectilinear section members comprising a first section member having a C-shaped right cross-section which is designed to be fitted over the two adjacent flanges of the two panels, and a second section member which is designed to be engaged inside the first section and between the adjacent flanges of the two panels, together with stiffening means for locking the two flanges into position between the two section members.

In a first embodiment of the invention, the means for stiffening the assembly system are constituted by the second section member or inner section member forming a wedge which is engaged by force in the first section member or outer section member.

Thus, in this first embodiment, the assembly system is stiffened over substantially the entire length of the outer section member, i.e. up substantially the entire height of the wall.

In a second embodiment, the two section members are mounted with a small amount of clearance onto the two flanges of two panels to be assembled together, and stiffening is obtained by means of a part which is engaged by force on the top portion and/or the bottom portion of the outer section member and of the two panels to eliminate the clearance between the flanges and the two section members level with said stiffening part.

Thus, in this second embodiment, the assembly system is stiffened only over a high and/or a low portion of the wall, it being understood that additional stiffening will be obtained over the remainder of the height of the wall by the action exerted by water pressure once the swimming pool has been filled.

In this second embodiment, each stiffening part advantageously forms a portion of a cornice which surrounds the swimming pool walls, said cornice also serving as anchoring means for retaining the edge of the waterproof liner or container defining the inside volume of the pool.

Finally, in a third embodiment, the two section members of the assembly system between two panels are likewise mounted with a small amount of clearance on the two flanges, and the assembly is stiffened merely by the force exerted by water pressure once the pool is filled.

In general, and whatever the embodiment, the outer section member defines a longitudinal groove having a right cross-section that is of dove-tail shape, and the internal section member is solid having a right cross-section that is substantially trapezoidal, i.e. the two section members are of right cross-sections that, overall, comprise two complementary shapes.

In addition, since the flanges on the two panels are connected to the panels by rounded bends, the waterproof liner that presses against the inside face of the panels will, under pressure from the water, fit closely against the shape of the two bends thus giving rise to a crease that extends vertically up the height of the wall.

Also, in a preferred embodiment of the invention, the second section member is shaped so as to leave a gap that enables the formation of such a crease to be avoided.

To this end, the second section member is shaped so as to project from the groove of the first section member and fit closely over the shapes of the bends of the flanges on the two panels on either side so as to end up in flush alignment with the panels.

For a swimming pool, struts are generally provided enabling the wall to be held up in a vertical position.

In accordance with the invention, it is advantageous to use the first section member for receiving one end of a strut. To this end, the back of the first section member is advantageously provided with a longitudinal groove, e.g. of dove-tail shape, in which it is possible to slide the end of the strut and then lock it in position by any appropriate means. According to another characteristic of the invention, the panels are prefabricated in standardized lengths, e.g. multiples of 0.50 m.

As a result, prefabricated and assembled together panels of the invention present numerous advantages, of which the following may be mentioned:

- individuals can assemble the wall of their own swimming pool themselves, without needing to resort to special tools or to qualified personnel;

manufacturing cost is low;

panels are of dimensions that are compatible with ease of handling, there being no need to use hoisting machinery; and the panels are easy to package, to store, and to transport.

Other advantages, characteristics, and details of the invention appear from the following explanatory description made with reference to the accompanying drawings given purely by way of example, and in which.

Figure 1:
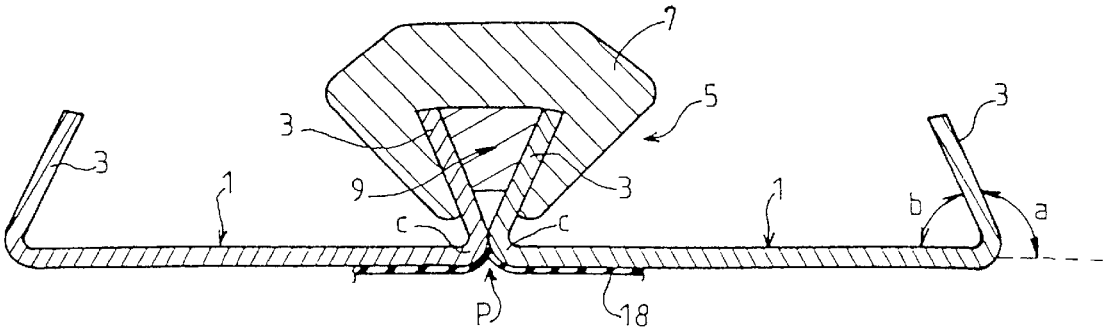
FIG. 1 is a section view on line I—I of FIG. 7 to show the principle whereby two prefabricated panels of a swimming pool wall constituting a first embodiment of the invention are assembled together.

Consider a swimming pool wall that is to be built up from prefabricated panels 1 which are assembled together on site. In general, each panel 1 is constituted by a sheet metal plate of rectangular shape, and two opposite sides of each panel 1, generally defining the height direction of the wall, are folded towards the same side of the panel 1 so as to form two flanges 3. In the example shown in FIG. 1, each flange 3 is obtained by means of a simple fold through an angle a which is greater than 90°, i.e. each flange 3 is folded so as to form an acute angle with the panel 1, or more generally so as to have a portion that faces the panel.

To mount a new panel in line with a panel that is already in place, a system 5 is used which, in a first embodiment, performs a wedging type of assembly obtained by matching shapes between the two adjacent flanges 3 of the two panels and two rectilinear section members comprising respectively an external section member 7 and an internal section member 9.

Figure 2:
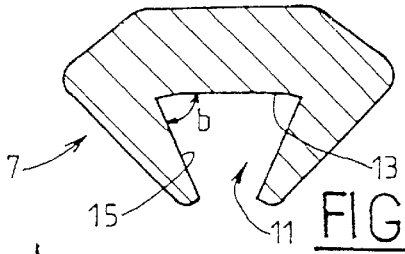
FIG. 2 is a section view of a first section member of the assembly system of the invention.

With reference to FIG. 2, the first section member 7 extends substantially up the full height of the panels 2, and its right section is generally C-shaped. More precisely, the first section member 7 defines a longitudinal dovetail-shaped groove 11 with an end wall 13 and two side walls 15. Each side wall 15 is inclined relative to the end wall 13 at an angle b which is the supplementary angle relative to the angle formed by each of the flanges 3 of the panels 1.

Figure 3:
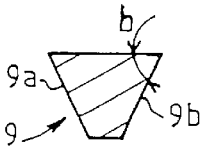
FIG. 3 is a section view of a second section member of the assembly system of the invention.

With reference to FIG. 3, the second section member 9 also extends over substantially the full height of the panels 2, and its right cross-section is generally trapezoidal in shape, being complementary to the shape of the groove 11 in the first section member 7. In other words, the second section member 9 has two opposite longitudinal sides 9*a* and 9*b* which are inclined at an angle b which is substantially equal to the angle of inclination of the side walls 15 of the groove 11 of the first section member 7.

With reference again to FIG. 1, there follows a description of how two panels 1 are assembled together by means of the two section members 7 and 9.

It is assumed that a first panel 1 is already in place and that a new panel 1 is to be assembled thereto.

In a first step, the first section member 7 is put into place so as to position the flange 3 of the panel 1 that is already in place inside the groove 11 of said first section member 7. This operation can be performed by pivoting the first section member 7 about the flange 3 of the already in place panel 1, or by causing it to slide or slip vertically along the flange 3.

In a second step, the new panel 1 is manipulated so as to bring one of its two flanges 3 freely into engagement in the groove 11 of the first section member 7. This operation can be performed by pivoting or by sliding the new panel 1. Once both flanges 3 of the two panels have been engaged with clearance in the groove 3 of the first section member 7, the new panel 1 is in a vertical position, and it is brought substantially into line with the panel 1 that is already in place so that the two flanges 3 are spaced apart from each other in the groove 11 of the first section member 7 so as to enable the second section member 9 to be inserted.

Finally, in a last step, the second section member 9 is placed vertically on the axis of the groove 11 in the first section member 7, and is then forced into said grove 11 by means of a tool, such as a mallet for example, so that it comes between the two flanges 3 of the two panels 1. This ensures that the two flanges 3 are locked in position in the groove 11 of the first section member 7 by a wedging effect, there preventing the new panel 1 from moving since it is now fixed to the panel 1 that was already in place and since the two panels 1 are brought automatically into alignment.

Assembling the two panels 1 together in this way therefore does not require any additional fastener means between the two panels 1.

In general, the flange 3 of each panel 1 forms a bend c of rounded shape at its fold line.

When assembly is performed as shown in FIG. 1, the bends c of two assembled together panels 1 come into contact with each other up the full height of the wall. However, when the waterproof liner or container 18 presses against the inside faces of the panels 1, after the entire swimming pool wall has been assembled together, then the liner 18 will be pushed by water pressure so as to fit closely against the shape of the two bends c, thereby creating a crease P between pairs of consecutive panels 1.

Figure 4:
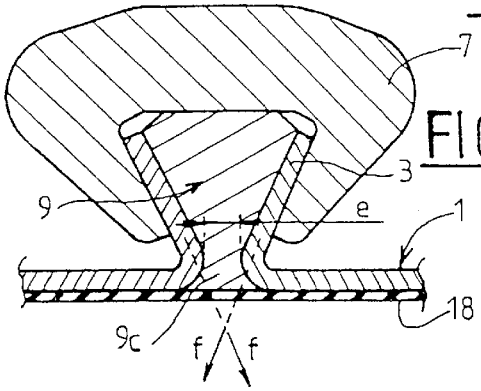
FIG. 4 is a section view of a preferred embodiment for the section members of the assembly system of the invention.

To prevent such creases being formed, the second section member 9 as shown in FIG. 4 is advantageously shaped so as to have a portion 9*c* that projects outside the groove 11 of the first section member 7 to fit closely over the shapes of the two bends c, thereby ensuring continuity of the surface between the two adjacent panels 1. In other words, the two panels 1 are kept slightly apart from each other so as to leave a gap e between the two adjacent flanges 3, which gap e is then filled by the portion 9*c* of the second section member 9.

This solution also offers the advantage of preventing the panels 1 from moving in any direction, and in particular in directions f parallel to the flanges 3. A force applied in one such direction f by the embankment around the pool could possibly cause one of the panels 1 to slide out from the groove 11 of a first section member 7.

Figure 5:
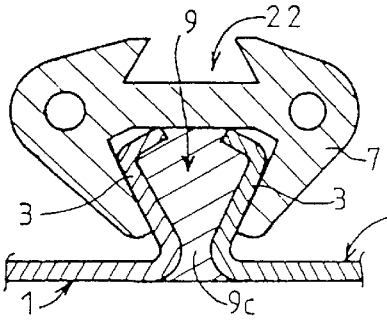
FIGS. 5 and 6 are section views for showing two variant embodiments of section members for the assembly system of the invention.
Figure 6:
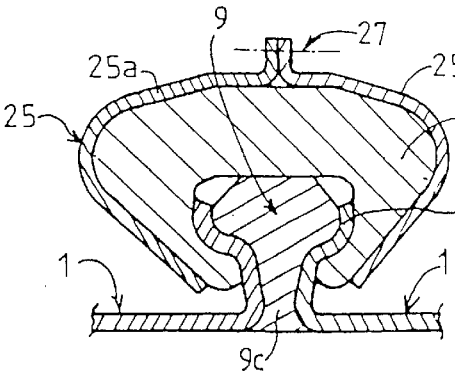
Figure 7:
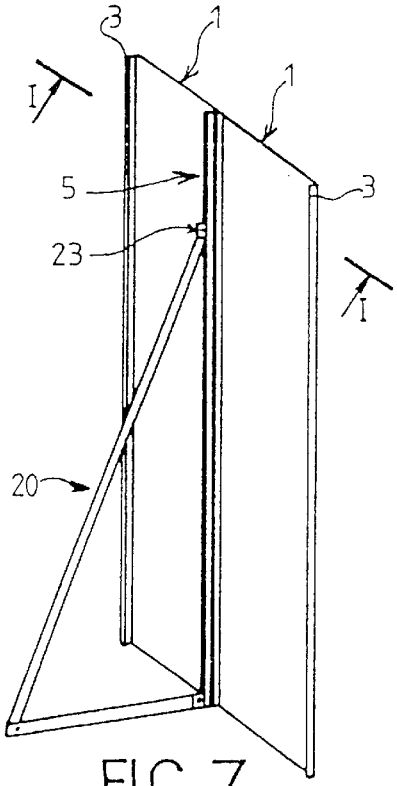
FIG. 7 is a diagrammatic perspective view to show two panels assembled together in accordance with the invention and in the presence of a reinforcing strut.

In general, as shown in FIGS. 5 and 6, each flange 3 of a panel 1 is not necessarily straight, but may be doubly-curved to form an S-shape. This serves in particular to reduce the volume of the second section member 9.

When it is necessary to stiffen the wall of the pool and to keep it in a vertical position, reinforcing struts 20 may be applied which are fixed to the back of the first section members 7. To this end, a second longitudinal groove 22 may be formed in the back of each first section member 7, e.g. having a dovetail-section, with it being possible to slide one end of a reinforcing strut 20 therealong prior to locking it in position by any appropriate clamping means 23.

Finally, as shown in FIG. 6, it is possible to apply a section member 25 made up of two portions 25*a* and 25*b* around the first section member 7, the two portions being interconnected along a clamping spine 27 so as to make the assembly stiffer, and also so as to allow a swimming pool accessory to be fixed thereto.

The section members 7 and 9 of each assembly system can be made of steel or of a plastics material, or they may be even be made of different materials specially adapted to their respective functions. For example, the section member 7 may be made of steel or of a very strong plastics material, while the section member 9 may be of polyethylene that has low mechanical strength but that slides very easily.

It is also possible to envisage a section member 7 made up of a plurality of lengths of different strengths and adapted to the varying pressures to which swimming pool walls are subjected.

By way of example, the section member 7 may be made up of a top length and a bottom length. The bottom length is subjected to greater pressure as exerted by earth or by water than is the top length, and so it may be of greater thickness to increase its stiffness.

Also, the wedge-forming section member 9 may perform its function without necessarily filling the entire hollow volume defined between the two adjacent flanges of two panels 1. The section member 9 could be circular in section.

Finally, concerning the angle a through which the flanges 3 of the panel 1 are folded, a flange 3 could naturally be formed by successive folds through angles of less than 90°, thereby constituting a variant that comes within the scope of the invention.

Figure 8:
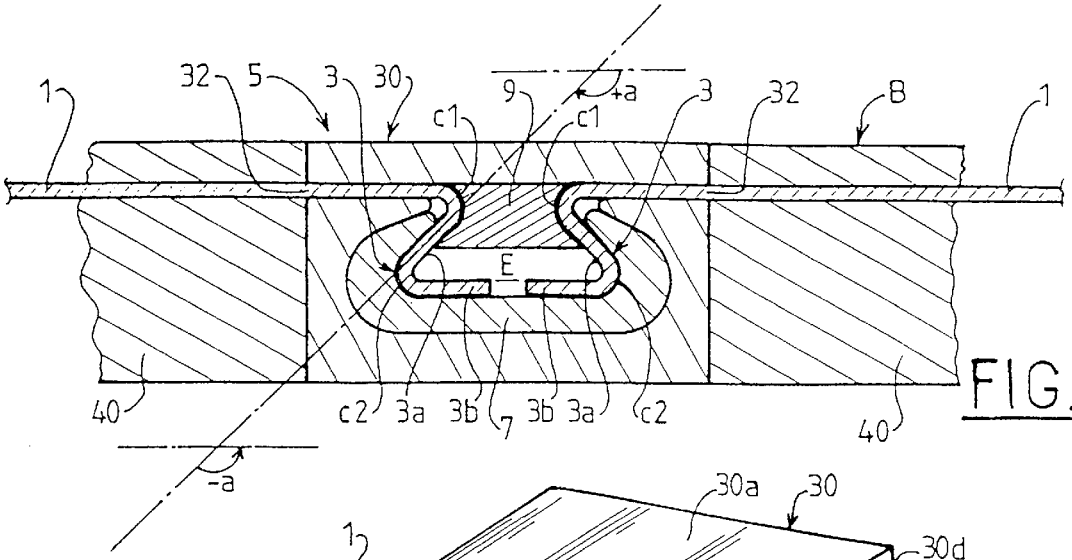
FIG. 8 is a section view of the assembly system constituting a second embodiment of the invention.
Figure 9:
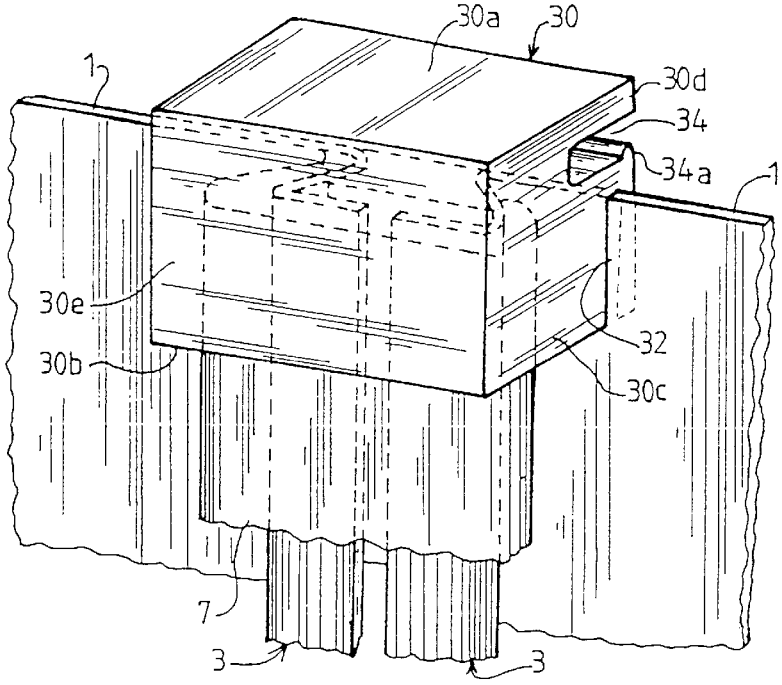
FIG. 9 is a fragmentary perspective view of the second embodiment as shown in FIG. 8.
Figure 10:
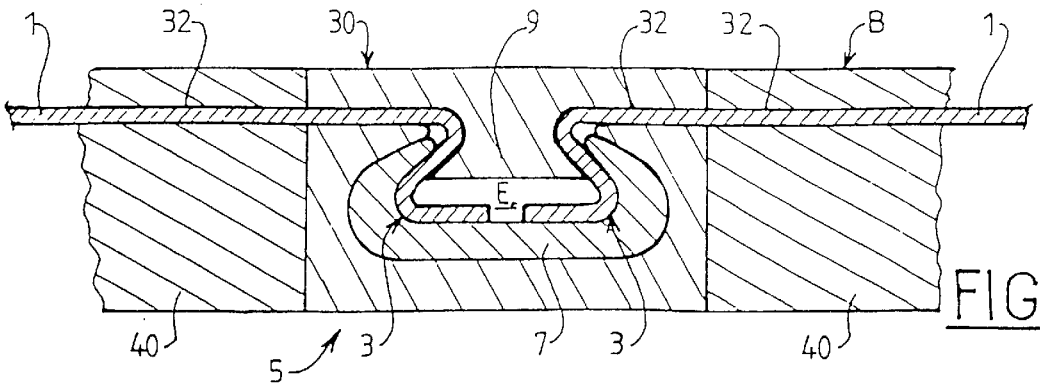
FIG. 10 is a section view of a variant of the second embodiment as shown in FIGS. 8 and 9.

A second embodiment of the system 5 for assembling together two consecutive panels 1 is shown in FIGS. 8 to 10.

Each flange 3 of a panel 1 is obtained by two folds to form an S-shape. In other words, each flange 3 has a first bend c1 that is the result of folding through an angle +a and a second bend c2 that is the result of folding through an angle −a.

Thus, each flange 3 has an intermediate portion 3*a* that is inclined or oblique, situated between the two bends c1 and c2, and also an end portion 3*b* extending substantially parallel to the plane of the panel 1.

As in the preceding embodiment, the assembly system 5 has two section members comprising respectively an external member 7 and an internal member 9. However, the internal section member 9 is no longer engaged by force within the external section member 7 in order to lock the two flanges 3 of two consecutive panels 1 in position.

The assembly is stiffened by means of a part 30 which is engaged by force over the top and/or bottom end portions of the external section member 7 and of the two panels 1, i.e. said part 30 does not extend over the full height of the wall.

This part 30 is in the form of a bloc constituting a rectangular parallelepiped having (FIG. 9) a top face 30*a*, a bottom face 30*b*, two side faces 30*c*, an inner vertical face 30*d* (on the inside of the pool), and an outer vertical face 30*e* (on the outside). A central gap E is left inside the part 30, which gap E opens out to the bottom face 30*b* and to the two side faces 30*c*. More precisely, the central portion of the space E has an outline which is complementary in shape to the outline of the external section member 7, and it opens out in each side face 30*c* via a slot 32 of a width that corresponds substantially to the thickness of the panels 1.

The external section member 7 still has a C-shaped right cross-section to define a longitudinal groove 11 in which the two flanges 3 of two consecutive panels 1 are received with clearance.

The internal section member 9 also extends over the full height of the groove 11 of the external section member 7 and its dimensions are such that:

- the intermediate portions 3*a* of the flanges 3 come substantially into contact with the side walls 15 of the groove 11 of the external section member 7;
- the end portions 3*b* of the flanges 3 come substantially into contact with the bottom 13 of the groove 11, but without coming into contact with each other; and
- the internal section member 9 comes substantially into contact with the intermediate portions 3*a* of the two flanges 3, fitting closely to the shape of the bends c1 while leaving an empty gap between the section member 9 and the end portions 3*b* of the flanges 3, i.e. the section member 9 does not completely fill the central gap E of the part 30.

Thereafter, to form a stiff connection between two panels 1, the part 30 is engaged by force on the top portion of the external section member 7 and on the panels 1 so as to eliminate all clearance within the part 30. The assembly is stiffened over the remainder of the height of the section member 7 by the action exerted by the pressure of water in the pool. Naturally, it is also possible to provide another stiffening part 30 at the bottom end of the first section member 7.

Advantageously, the stiffening part 30 also forms a portion of a cornice B that is designed to surround the pool wall formed by the set of panels 1.

More precisely, the cornice B is formed by the stiffening parts 30 where assemblies are made between pairs of consecutive panels 1, and by juxtaposed parts 40 which provide continuity for the cornice between the stiffening parts 30.

Each cornice part 40 has only a slot 32 opening out to the bottom face of the part 40 enabling it to be fitted astride the panel 1, as a friction fit.

In addition, the inside vertical face 30*d* of the parts 30 and 40 making up the cornice B includes a groove 34 which, once the cornice B has been fully installed, forms a continuous groove into which the edge of the container 18 can be secured for retention purposes. A rib or projection 34*a* projects into the groove 34 so as to facilitate anchoring the container 18.

In a variant embodiment shown in FIG. 10, the top portion is the second section member 9 or internal section member can be integrated in the stiffening part 30.

Finally, in a third embodiment constituted a variant of the second variant, it is possible to omit the stiffening parts 30 since experience shows that each assembly system can be stiffened merely by the action exerted by water pressure, once the pool has been filled. Such an embodiment is particularly suitable for pools of generally circular shape.

The invention also relates to a swimming pool wall built up of prefabricated panels 1 assembled together in pairs using one or other of the above-described assembly systems 5.

I claim:

1. A wall assembly system comprising prefabricated panels for forming a water-retaining wall, each panel comprising a sheet metal plate which defines substantially the height of the wall and has two opposite edges, said edges being folded to the same side of the panel to form two flanges, wherein two consecutive panels disposed vertically side by side are assembled together by matching shapes between the two adjacent flanges of the two panels and two rectilinear rigid section members comprising a first section member having a C-shaped right cross-section which is designed to be fitted over the two adjacent flanges of the two panels, and a second section member which is designed to be engaged longitudinally inside the first section and between the adjacent flanges of the two panels.

2. An assembly system according to claim 1, characterized in that the first section member (7) defines a longitudinal dovetail groove (11), and in that the second section member (9) has a generally trapezoidal right cross-section which is complementary to the shape of the dovetail of the groove (11) in the first section member (7).

3. An assembly system according to claim 1 or 2, characterized in that the second section member (9) includes a portion **(9*c*) projecting from the groove (11) of the first section member (7) so as to fit closely over the shapes of the two bends (c) where the two flanges (3) are folded, and so as to come flush with the panels (1)**.

4. An assembly system according to any preceding claim, characterized in that the first section member (7) also has a second longitudinal groove (22) for adjustably positioning one end of a reinforcing strut (20).

5. An assembly system according to any preceding claim, characterized in that each flange (3) of a panel (1) is obtained by two folds to form an S-shape, such double-fold defining a first bend (c1) through an angle (+a) followed by a second bend (c2) through an angle (−a), a sloping intermediate portion **(3*a*) situated between the two bends (c1, c2), and an end portion (3*b*) extending substantially parallel to the plane of the panel (1)**.

6. An assembly system according to claim 5, characterized in that the second section member (9) fits closely around the first bend (c1) of both flanges (3) and remains at a distance from the end portions **(3*b*) of the two flanges (3)**.

7. An assembly system according to claim 1, wherein the second section member is so configured that it forms a wedge that is engaged by force inside the first section member.

8. A pool wall built up from prefabricated panels assembled together in pairs by means of an assembly system as defined by any preceding claim.

9. A wall assembly system comprising a plurality of prefabricated panels, each panel comprising a sheet metal plate which defines substantially the height of the wall and has two opposite edges, said edges being folded to the same side of the panel to form two flanges, wherein two consecutive panels disposed vertically side by side are assembled together by matching shapes between the two adjacent flanges of the two panels and two rectilinear section members comprising a first section member having a C-shaped right cross-section which is designed to be fitted over the two adjacent flanges of the two panels, and a second section member which is designed to be engaged inside the first section and between the adjacent flanges of the two panels, together with a stiffening means for locking the two flanges into position between the two section members comprising a part engaged by force on the top or bottom or both end portions of the first section member and on two consecutive panels.

10. An assembly system according to claim 9 wherein said part is substantially in the form of a rectangular parallelepiped having a top face, a bottom face, two side faces, an inside vertical face on the inside of the pool, and an outside vertical face on the outside of the pool, and wherein the part includes a hollow internal central gap whose outline is complementary in shape to the outline of the first section member, and wherein the inside gap opens out to the bottom face of the part and to the two side faces thereof via slots of width substantially equal to the thickness of the panels.

11. An assembly system according to claim 10, wherein each part forms a portion of a cornice which surrounds the pool wall.

12. A wall assembly system comprising a plurality of prefabricated panels, each panel comprising a sheet metal plate which defines substantially the height of the wall and has two opposite edges, said edges being folded to the same side of the panel to form two flanges, wherein two consecutive panels disposed vertically side by side are assembled together by matching shapes between the two adjacent flanges of the two panels and two rectilinear section members comprising a first section member having a C-shaped right cross-section which is designed to be fitted over the two adjacent flanges of the two panels, and a second section member which is designed to be engaged inside the first section and between the adjacent flanges of the two panels, together with a stiffening means for locking the two flanges into position between the two section members, said stiffening means comprising water in a pool formed by the wall exerting sufficient pressure to lock the two flanges into position between the section members.

* * * * *

UNITED STATES PATENT AND TRADEMARK OFFICE

CERTIFICATE OF CORRECTION

PATENT NO. : 5,896,715
DATED : April 27, 1999
INVENTOR(S) : Maupas

It is certified that error appears in the above-identified patent and that said Letters Patent is hereby corrected as shown below:

Title page,
Item [56], References Cited, FOREIGN PATENT DOCUMENTS, "of 1953" should read -- 6/1953 --

Column 7,
Lines 5-6, 11-12, 18, 22 and 29-30, "characterized in that" should read -- wherein --;
Lines 6, 14 and 18, cancel "(7)";
Line 7, cancel "(11)" and "in that";
Lines 8, 12 and 30, cancel "(9)";
Line 10, cancel "(11)" and "(7)";
Line 11, cancel "or 2";
Line 13, cancel "(9c)" and "(11)";
Line 15, cancel "(c)", "(3)" and "and";
Lines 16 and 28, cancel "(1)";
Lines 17 and 21, "any preceding claim" should read -- claim 1 --;
Line 19, cancel "(22)";
Line 20, cancel "(20)";
Line 22, cancel "(3)" and "(1)";
Line 24, cancel "(c1)" and "(+a)";
Line 25, cancel "(C2)" and "(-a)";
Line 26, cancel "(3a)" and "(c1, c2)";
Line 27, cancel "(3b)";
Line 31, cancel "(c1)" and "(3)";
Line 32, cancel "(3b)" and "(3)";
Cancel lines 37-39.

Signed and Sealed this

Seventeenth Day of June, 2003

JAMES E. ROGAN
*Director of the United States Patent and Trademark Office*